US012576949B2

(12) United States Patent
Duff

(10) Patent No.: US 12,576,949 B2
(45) Date of Patent: Mar. 17, 2026

(54) USER HANDLE FOR WATERSPORTS DEVICE

(71) Applicant: ZUP, LLC, Summerville, SC (US)

(72) Inventor: Glen Wade Duff, St. Thomas, VI (US)

(73) Assignee: ZUP, LLC, Summerville, SC (US)

( * ) Notice: Subject to any disclaimer, the term of this patent is extended or adjusted under 35 U.S.C. 154(b) by 550 days.

(21) Appl. No.: 18/161,982

(22) Filed: Jan. 31, 2023

(65) Prior Publication Data

US 2023/0257079 A1 Aug. 17, 2023

Related U.S. Application Data

(60) Provisional application No. 63/310,844, filed on Feb. 16, 2022.

(51) Int. Cl.
*B63B 34/63* (2020.01)

(52) U.S. Cl.
CPC ..... *B63B 34/63* (2020.02)

(58) Field of Classification Search
CPC ..... B63B 34/00; B63B 34/63; A45C 3/00; A45C 3/001; A45C 13/00; A45C 13/008; A45C 13/103
USPC ..... 441/69
See application file for complete search history.

(56) References Cited

U.S. PATENT DOCUMENTS

| | | | | | |
|---|---|---|---|---|---|
| 5,046,978 | A * | 9/1991 | Howerton | B63B 34/52 | 114/345 |
| 5,360,360 | A * | 11/1994 | Peterson | B63B 34/52 | 441/66 |
| 6,010,382 | A * | 1/2000 | Kennedy | B63B 34/52 | 441/66 |
| 6,065,421 | A * | 5/2000 | Haller | B63B 34/26 | 114/345 |
| 6,367,405 | B1 * | 4/2002 | Smiley | B63B 34/23 | 114/347 |
| 10,781,028 | B2 * | 9/2020 | Munie | A45C 3/001 | |
| 10,827,808 | B2 * | 11/2020 | Seiders | A45C 3/001 | |

* cited by examiner

*Primary Examiner* — Lars A Olson
(74) *Attorney, Agent, or Firm* — Harness, Dickey & Pierce, P.L.C.

(57) ABSTRACT

A flexible, no through hole, loop handle is disclosed for a watercraft. The customary loop handle through hole is completely closed by a particular, sturdy, flexible, stretchy, mesh, or other puncture resistant, water suited and water permeable fabric. The handle grip portion is a fabric tube enclosing a squeezable foam segment that enables a user to obtain a complete finger overlapped with thumb wrapped grip on the handle. The closed through hole eliminates the risk of a user's hand or other limb segment being intentionally or inadvertently extended through the handle. The mesh fabric is sufficiently flexible to allow a full finger wrapped grip around the fabric tube of the handle such that no aspect of user grip is compromised by virtue of the mesh fabric.

18 Claims, 6 Drawing Sheets

USER HANDLE FOR WATERSPORTS DEVICE

CROSS-REFERENCE TO RELATED APPLICATIONS

This application claims priority under 35 U.S.C. § 119 to U.S. Provisional Application No. 63/310,844, filed on Feb. 16, 2022, the entire contents of which are incorporated herein by reference.

FIELD OF THE INVENTION

The invention is related to the field of watersports, and watercraft used in their participation. Specifically, the invention is directed to handles to be held by a user during use of a watercraft as a rider or co-rider. The handle is used by the rider to maintain their position on and an association with the watercraft.

BACKGROUND OF THE INVENTION

Watersports are very popular around the world. These range from individual watersports like swimming and diving, to those relying on equipment, i.e., surfing and boogie boards, to those that require a form of propulsion, either internal or external to the device. Those with internal propulsion would include boats and jet skis, and those with external propulsion would be the tow-behind variety like wake boards and tubes and skis.

Invariably when there is a piece of equipment to engage to use, or to make the watersport safer for participants, some sort of attachment device or mechanism is necessary to keep the user and device proximate each other. The attachment varies in accord with the purpose of the respective association between the user and the device. For surfboards and boogie boards, for example, a short strap is typically used that is loosely attached to the participant and fixedly attached to the board. When the user is tossed off during use, the strap keeps the board nearby so that they can get back on when conditions permit, but the strap also keeps the board far enough away to avoid injury when the participant and board are tossed in the surf.

For other watersports, like tow behind or other ridden watersports devices, there are usually handles for a user to grasp and maintain their position on the device. This handle system works but is not ideal. A typical handle is one size and is usually in the form of a very sturdy or rugged sewn open loop, or hard open loop, with each end of the loop securely attached to an exposed surface of a watersport's device. By virtue of being one size, this means for some users the handle is well suited, for others it is too small or too large. In addition, depending on where the handle is, there is a risk that a user might insert more than their hand into or through the loop portion. If a user has small limbs or is young, they may be able to insert a significant portion of a leg or arm through a handle and may even purposefully do so in order to retain their position on the watercraft or device. They may even put their whole arm up inside the handle, up to their elbow. (Even though safety literature may recommend against it). They may put their hand and wrist in the handle upside down. (Even though safety literature may recommend against it). Some may even try to ride with their feet and ankles in the handles. (Even though safety literature may recommend against it). And, while this may seem reasonable to the uninitiated user, it can lead to tragic consequences. If a person is tossed from the device but is unable to release themselves from the device, they can be dragged in an unintended fashion until the boat operator is alerted to their peril and stops. But, by then, harm may already have transpired. Because tubes and other inflatables and even wake boards, for example, easily toss and turn and sometimes flip over, users with hands and limbs in handles can end up causing joint damage, broken bones, or even worse. If the device or tube goes upside down and the rider cannot get released, they could even drown before the boat driver can get back to them.

SUMMARY OF THE INVENTION

The invention is directed to a sturdy flexible loop handle that has no through-hole between the handle loop and the underlying watersports craft or device. In short, a closed handle that relies on grip, alone, for a user to retain an association with the underlying craft or device. The handle can be one size fits all but can also be sized in anticipation of the likely range of users and/or have differing calibers/thicknesses for the main loop portion of the handle along its length. The location of, what in an ordinary handle is, the through hole is blocked by a flexible but tear and puncture resistant mesh. Water is easily able to pass through, but the hands, finger, and limbs of a user, regardless of strength or dexterity are prevented from passing completely through the loop of the handle. In this way, when the grip is released by decision of the watercraft rider/user, they are in fact released from the craft.

This is far safer, because it prevents incorrect handle holding, by preventing people from sticking their hands, wrists or appendages through the handles. It is also relatively low cost, when compared to other solutions because of the minimum addition of a suitable flexible sturdy water permeable mesh fabric material it takes to make it functional. By virtue of the folded fabric, folded over a squeezable foam tube, primary construction, it starts out and remains comfortable to grasp for extended periods and, because of the softness of the flexible fabric used, there is little chance of chaffing despite bare handed use.

The handle construction is suitably strong, such that the tube handles will not come off, even if the craft or device or tube is flipped over (which happens a lot through a day of activity). Although the handles are "closed off", since it utilizes an open weave flexible strong mesh fabric, water is able to flow through the handle and not create sufficient force to tear a handle off.

Most importantly, fingers cannot get through the small mesh on the fabric. Thus, the balance of the limb, i.e., hand, wrist, forearm, elbow, cannot be placed through the handle either. When a person grabs the handles on the tube/device/craft they will not be encumbered or find resistance to their anticipated grip. The handle tube can be completely finger gripped with a 360-degree plus finger hold, even though no handle through hole exists, because of the flexibility and amount of fabric used to "CLOSE" the gap between the handle and the tube/device/craft. The mesh fabric closing the through hole can itself wrap at least 180 degrees around the top handle loop from its underside attachment seam. Thus, whether a child or adult grabs the handle, it flexes just enough for each situation such that the handle is fully gripped, with a complete finger and thumb overlap, in just the same way as if no through hole covering fabric were present. Hence, although safer without the through hole, no grip is lost because it is gripped in just the same way and has the same feel to the user.

The tuck and/or fold of the mesh fabric under the handle, whether symmetrical or asymmetrical, can offer design and sewing variations needed for different situations. For example, a location where a handle may also engage or be engaged by a foot instead of a hand, the mesh may be stiffer and tighter to resist the push of a foot. Whereas a "hands only" location could be, for example, softer and more pliable to assure a more supple and complete grip.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limiting of this disclosure.

DETAILED DESCRIPTION

Figure 1:
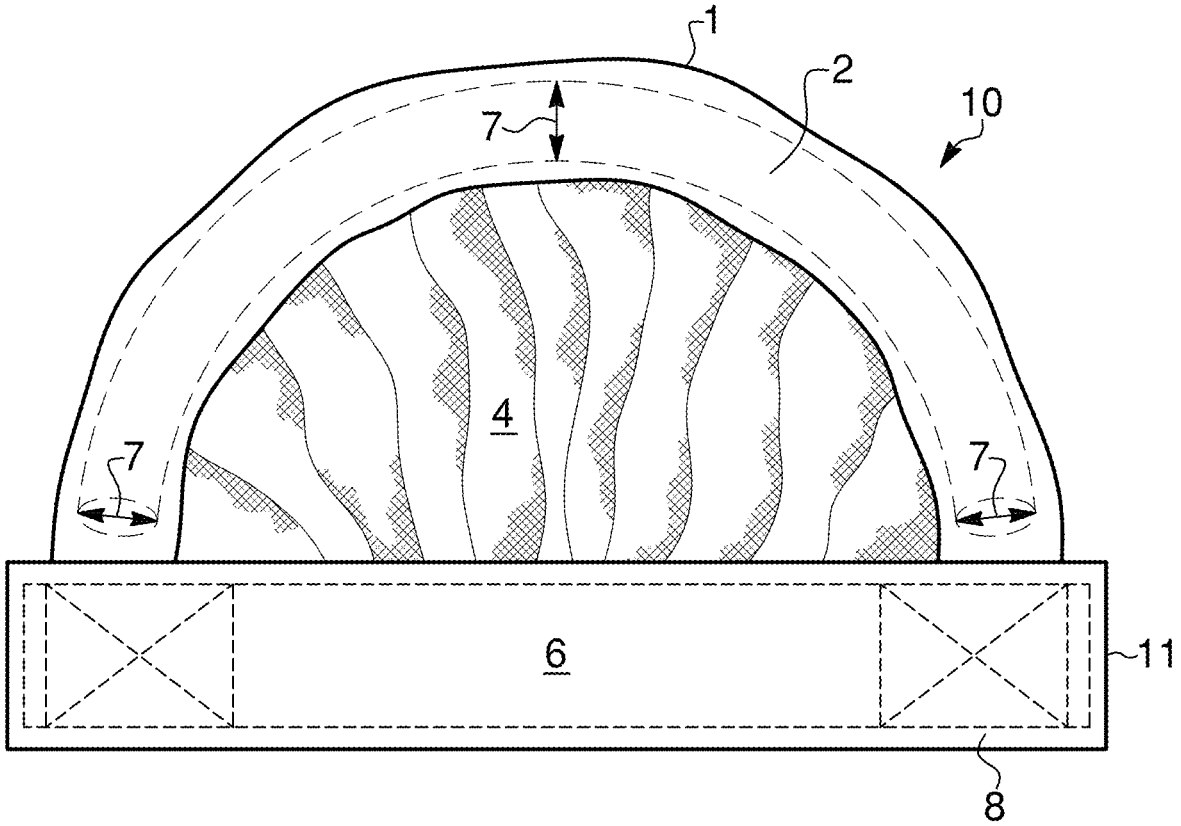
FIG. 1 shows a side view of a handle in accord with one embodiment of the present invention.
Figure 2A:
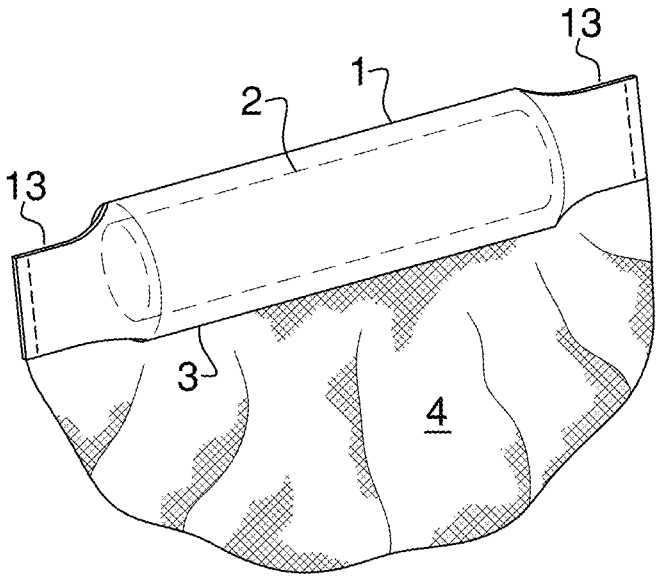
FIGS. 2A, 2B, and 2C show a sequence of forming a handle in accord with the present invention for sewing to an associated attachment strap for further connection to an associated watercraft or tube.
Figure 2B:
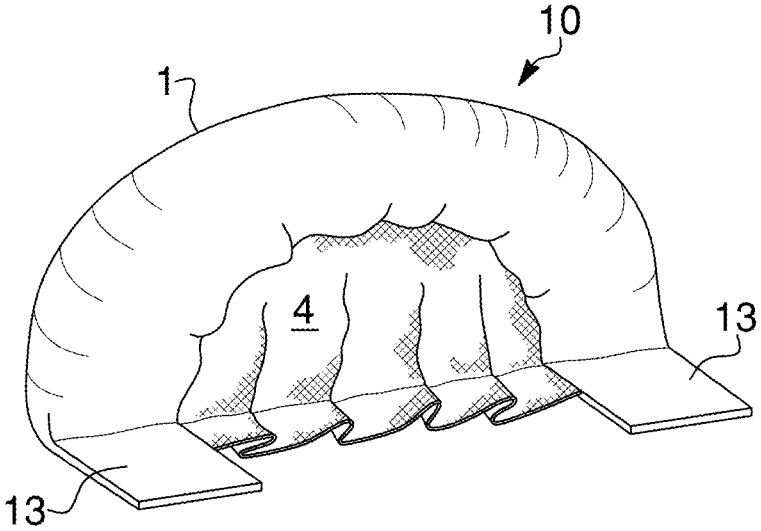
Figure 2C:
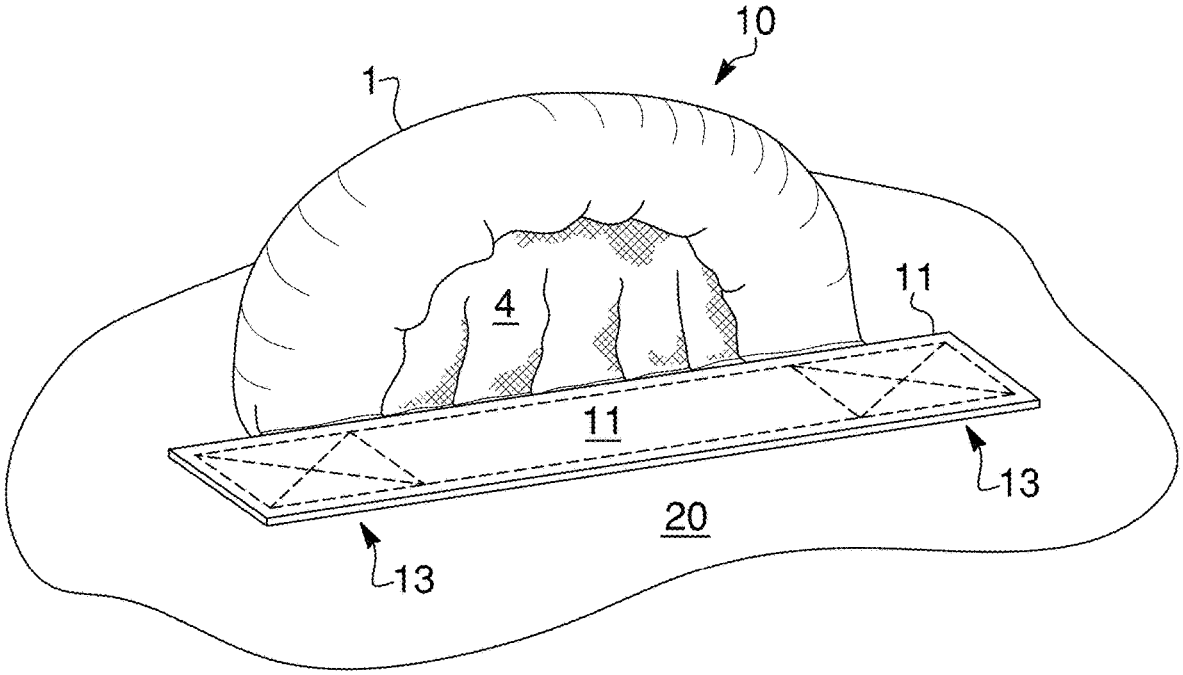

With reference to the drawing FIGS. 1 and 2A, 2B, and 2C, an embodiment of a handle 10 in accord with the present invention will be described.

The handle 10 is made up of several primary components firmly attached one to the other. The first component is a fold over fabric cover 1, preferably made of a sturdy non-stretch, non-tear, nylon weave. This cover 1 is folded to enclose a soft squeezable foam tube 2 of sufficient resilience to provide something to wrap palms and fingers around and to create a form to grip beneath the cover 1. The folded over tube cover 1, that contains the foam tube 5, preferably E.P.E., is longer than the contained foam tube and enables the creation of a pair of flattened sewing tabs 13 at the ends of the folded tube cover 1. The tube cover can be sealed via stitching and/or heat around its edges and to create the tabs 13. The handle tube cover 1 is then attached along one side thereof to a sturdy, also preferably nylon, mesh fabric 4 that is both puncture and tear resistant. The fabric 4 is selected to be both water and sun (U.V.) resistant and maintains flexibility and suppleness. It is gathered along pleats or folds, or natural stretchiness, when the handle is bent to a U-shape form as a loop for attachment to an underlying handle attachment location or support fabric segment 20 associated with the tube or watercraft. The ends of the tube 1, i.e., the flattened tabs 13, and the pleated/stretchy mesh fabric 4 are collectively sewn/sealed to a sew strap 11 using stitching 8. The handle 10 can then be further stitched or fused via attaching sew strap 11 to an underlying portion of the watercraft or tube or tube cover 20 or other area on the tube or craft intended for overlying handle attachment.

The nylon tube 1 fabric is preferably made of Polypropylene, with a width of about 45-60 mm, and a thickness of about 1.5 to 2 mm per layer and a length of at least 150 mm. The total length is dependent on the intended user of the device. A length of 150 mm would be for small hands and feet, whereas 200 to 250 mm or longer lengths would be for adult and larger hands and feet. The contained squeezable foam 2 may be in the form of a separate tube of EPE or it may be injected into the cavity within the tube and expanded and cured in position. The foam tube can be a consistent diameter 7, of between about 8 and 30 mm, along its entire length, or can be tapered from the center, about 12-30 mm to about 5-12 mm, towards the ends, or along its entire length end to end, to create a variable tapered diameter grip. If tapered from a larger center, for example, the center of the grip would be suited to larger hands and smaller hands could grip towards either end. The inner edges 3 of the tube cover 1 may be heat sealed and/or stitched to each other and to stretchy mesh 4. The combination of the tube and mesh can then be associated with the sew strap 11, before being attached to the fabric area 20 on the tube or watercraft which, itself, may be suitably reinforced to receive an attached handle. The sew strap is quite thick and sturdy and is, for example, a heavy polypropylene about 40-60 mm wide and in the range of 1.5-3.0 mm in thickness, with a length matched to the U-shaped handle. The mesh fabric 4 is preferably a sturdy but flexible lycra or spandex type material. Preferably, for example, a stretchy flexible polyester mesh at about 260 grams per yard. The gathered material 4 should be loose and/or flexible enough such that the material, when pulled or stretched up from the handle through hole towards and alongside the tube cover 1, is flexible and extensible enough to substantially wrap around to the top of the body of the tube cover 1. In this way, when a user grips the tube cover 1, with their fingertips inserted into the through hole pocket created by stretchy mesh fabric 4, their fingertips can completely wrap around the tube cover 1 and press against the heal or center of their palm through the fabric 4 in a naturally firm multi-finger hold with their thumb and palm heel wrapped and overlapped atop the ends of their fingers for a grip exceeding a 360 degree wrap of the handle.

Figure 3:
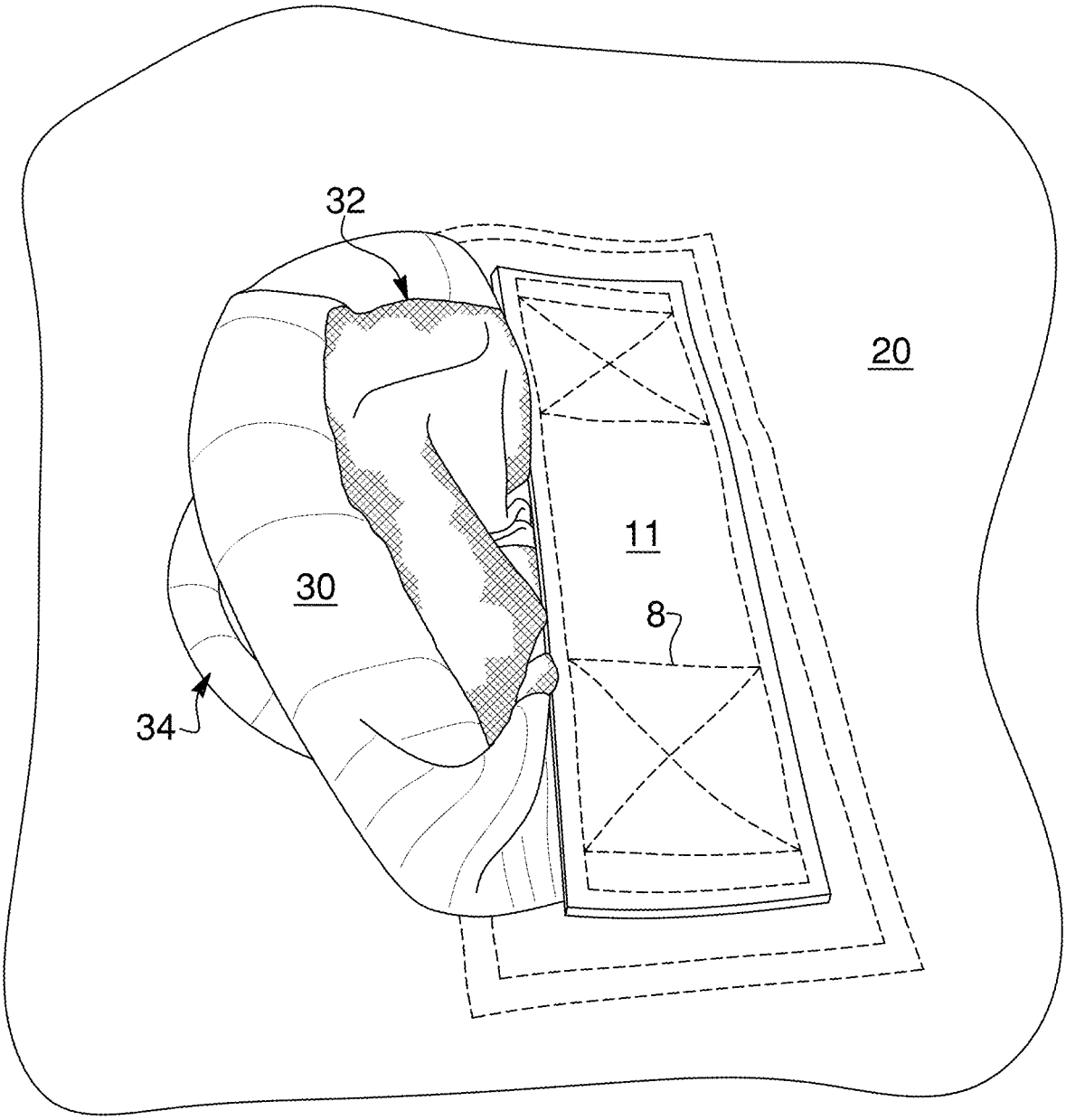
FIG. 3 shows a single handle in accord with the present invention from a rearward position.
Figure 4:
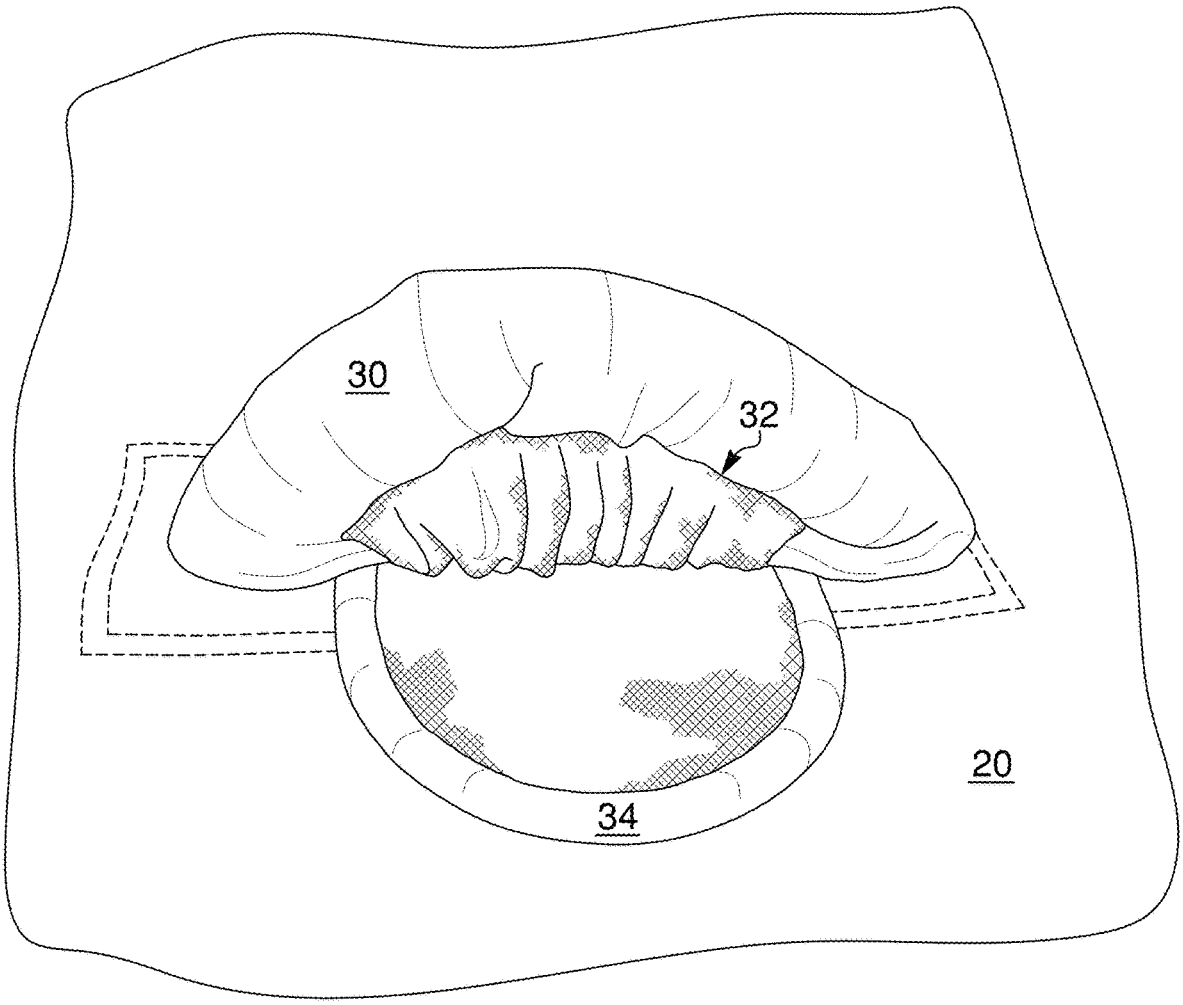
FIG. 4 shows the handle of FIG. 3 from a side position.

FIG. 3 shows a rearward view of a handle in accord with a second embodiment of the present invention. The handle 30 is made from a folded nylon that contains a foam tube inside. The hole closing fabric 32 is a flexible, permeable, non-mesh fabric that resists tears and punctures and enables water to flow through. The handle 30 also includes a second attachment flap 34 opposite the sew strap 11. With reference to FIG. 4, the second attachment flap 34 is made of a thick laminated EVA fabric, about 1.5 to 2.5 mm thick, but is substantially covered by a soft fabric 32 like that used to close the handle through hole. The soft fabric can be made of a polyester Jersey type fabric, at about 160 grams per yard. This makes the handle less likely to chaff or abrade a user's hands and fingers and knuckles in use. The second attachment flap 34 also provides a more secure association between the handle 30 and the underlying tube or watercraft. The second flap 34 is sewn or heat sealed to the sew strap 11 and is then sewn and/or sealed to the underlying fabric 20. The surrounding piping of the second attachment flap 34 can be a Polypropylene, folded in half from a 15-25 mm piece, and sewn. The thickness of the piping for 34 can be about 0.2 to 0.4 mm, i.e., 0.3 mm thick.

Figure 5:
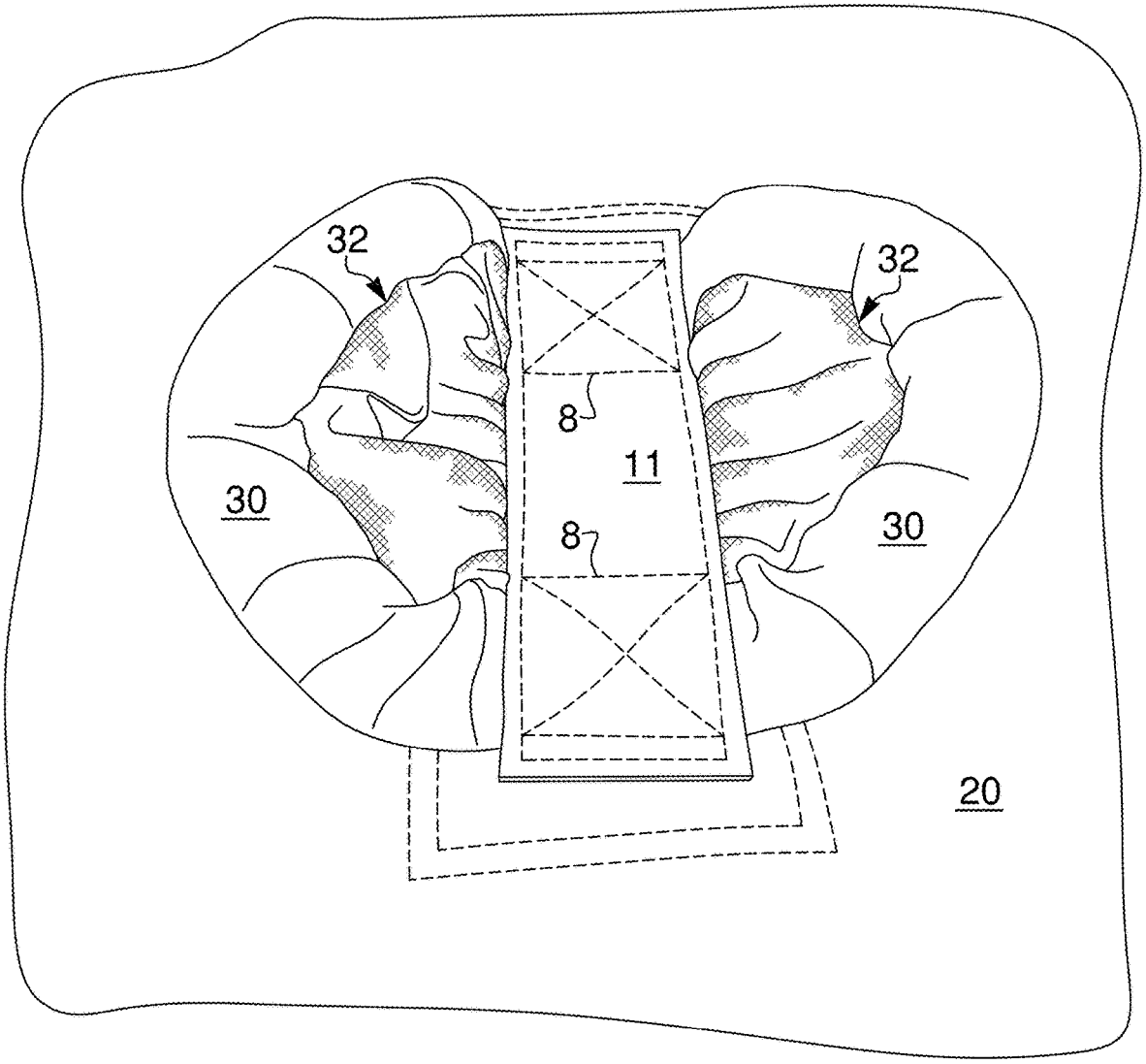
FIG. 5 shows a "double" handle in accord with the present invention.

FIG. 5 shows a double handle version of the handle shown in FIGS. 3 and 4. The handle 30 is made of the same primary elements, i.e., a cover tube with end tabs and a contained foam tube therein. The pair of handles 30 are positioned one opposite the other and are both sewn 8 and/or sealed to a shared central sew strap 11. The sew strap 11 is in turn attached to the watercraft 20 covering/outer surfaces via stitching and/or sealing. The double handle may optionally include a pair or one of an additional second attachment flap(s) 34 as shown in FIGS. 3 and 4.

What is claimed is:

1. A first handle for attachment to an underlying surface, comprising:

a fabric tube, having a first end and a second end and a length between said ends, defined by a piece of folded fabric with a pair of opposed edges thereof attached one to the other from the first to the second end, the fabric tube defining a hollow segment within the tube, and flattened ends tabs proximate the first and second ends;

a foam tube contained within the hollow segment, and between the flattened end tabs;

a flexible water permeable stretching fabric connected along an edge of said stretching fabric to the tube along its length;

the tube being formed as a U-shape surrounding said flexible fabric within said U-shape;

and, a sew strap attached to the respective end tabs and unenclosed edges of the flexible fabric so as to create a closed loop handle shape suitable for further attachment via said sew strap to said underlying surface.

2. A handle as in claim 1, further comprising:

a second attachment strap attached to said sew strap and extending on a side of the U-shape opposite said sew strap to said flattened tabs attachment.

3. A handle as in claim 2, wherein:

said second attachment strap has a semi-circular shape corresponding to the shape of the U-shape fabric tube.

4. A handle as in claim 3, wherein:

said second attachment strap is covered on an upper surface thereof with a softer fabric than the fabric making up the fabric tube.

5. A handle as in claim 1, wherein:

said foam tube is tapered from a larger center diameter of the foam tube towards smaller diameter ends.

6. A handle as in claim 1, wherein:

said foam tube is tapered from a larger end at one end of the foam tube towards a smaller diameter end section at an opposite end of the foam tube.

7. A first handle as in claim 1, further comprising:

a second handle positioned on an opposed side of said sew strap from said first handle.

8. A handle as in claim 7, further comprising:

a pair of semi-circular secondary attachment flaps positioned in parallel and connected to said sew strap.

9. A handle as in claim 8, wherein:

said pair of second attachment straps are covered on upper surfaces thereof with a softer fabric than the fabric making up the fabric tube.

10. A first handle for attachment to an underlying surface, comprising:

a fabric tube, having a first end and a second end and a length of at least 150 mm between said ends, defined by a piece of folded fabric with a pair of opposed edges thereof attached one to the other from the first to the second end, the fabric tube defining a hollow segment within the tube, and flattened ends tabs proximate the first and second ends;

a foam tube contained within the hollow segment, and between the flattened end tabs, an outer diameter of said fabric tube being at least 8 mm;

a flexible water permeable stretching fabric connected along an edge of said stretching fabric to the tube along its length;

the tube being formed as a U-shape surrounding said flexible fabric within said U-shape;

and, a sew strap attached to the respective end tabs and unenclosed edges of the flexible fabric so as to create a closed loop handle shape suitable for further attachment via said sew strap to said underlying surface.

11. A handle as in claim 10, further comprising:

a second attachment strap attached to said sew strap and extending on a side of the U-shape opposite said sew strap to said flattened tabs attachment.

12. A handle as in claim 11, wherein:

said second attachment strap has a semi-circular shape corresponding to the shape of the U-shape fabric tube.

13. A handle as in claim 12, wherein:

said second attachment strap is covered on an upper surface thereof with a softer fabric than the fabric making up the fabric tube.

14. A handle as in claim 10, wherein:

said foam tube is tapered from a larger center diameter of the foam tube towards smaller diameter ends.

15. A handle as in claim 10, wherein:

said foam tube is tapered from a larger end at one end of the foam tube towards a smaller diameter end section at an opposite end of the foam tube.

16. A first handle as in claim 10, further comprising:

a second handle positioned on an opposed side of said sew strap from said first handle.

17. A handle as in claim 16, further comprising:

a pair of semi-circular secondary attachment flaps positioned in parallel and connected to said sew strap.

18. A handle as in claim 17, wherein:

said pair of second attachment straps are covered on upper surfaces thereof with a softer fabric than the fabric making up the fabric tube.

* * * * *